US005752154A

United States Patent [19]

Maruyama et al.

[11] Patent Number: 5,752,154

[45] Date of Patent: May 12, 1998

[54] SHEET POST-TREATMENT APPARATUS OF LINE-UP FREE TYPE

[75] Inventors: Hiroyoshi Maruyama, Yokohama; Yuji Takahashi, Tokyo; Yoshikuni Toyama, Yokohama; Shinichi Tanada, Isehara; Toshihiko Kusumoto; Masahiko Yashiro, both of Yokohama, all of Japan

[73] Assignee: Canon Kabushiki Kaisha, Tokyo, Japan

[21] Appl. No.: 608,212

[22] Filed: Feb. 28, 1996

Related U.S. Application Data

[63] Continuation of Ser. No. 191,261, Feb. 3, 1994, abandoned.

[30] Foreign Application Priority Data

| | | | |
|---|---|---|---|
| Feb. 7, 1993 | [JP] | Japan | 5-042011 |
| Feb. 7, 1993 | [JP] | Japan | 5-042012 |
| Feb. 7, 1993 | [JP] | Japan | 5-042017 |

[51] Int. Cl.[6] ..... G03G 15/00

[52] U.S. Cl. ..... 399/407; 270/52.01; 271/290; 399/408

[58] Field of Search ..... 355/308, 309, 355/318, 319, 321, 324, 325, 323; 399/407, 408; 270/52.01, 58.01; 271/287, 290

[56] References Cited

U.S. PATENT DOCUMENTS

| | | | |
|---|---|---|---|
| 4,248,525 | 2/1981 | Sterrett | 271/3.1 X |
| 4,530,593 | 7/1985 | Kasuga et al. | 355/323 |
| 4,750,731 | 6/1988 | Dei et al. | 271/287 |
| 4,900,009 | 2/1990 | Kitahara et al. . | |
| 4,961,092 | 10/1990 | Rabb et al. | 355/323 |
| 5,172,162 | 12/1992 | Taneda | 399/408 X |
| 5,177,546 | 1/1993 | Tsubo | 355/314 |
| 5,177,548 | 1/1993 | Nakamura et al. | 355/324 |
| 5,213,317 | 5/1993 | Mandel et al. | 270/53 |
| 5,326,093 | 7/1994 | Sollitt | 271/306 |
| 5,384,634 | 1/1995 | Takehara | 355/323 |
| 5,461,469 | 10/1995 | Farrell et al. | 399/407 |

FOREIGN PATENT DOCUMENTS 63-262373 10/1988 Japan .

*Primary Examiner*—William J. Royer

*Attorney, Agent, or Firm*—Fitzpatrick, Cella, Harper & Scinto

[57] ABSTRACT

The present invention provides a sheet post-treatment apparatus for receiving a sheet material on which an image was formed by an image forming apparatus and for post-treating such sheet material and for sending the sheet material to a next post-treatment apparatus. A sheet receiving opening has the same height as a sheet sending opening.

10 Claims, 21 Drawing Sheets

SHEET POST-TREATMENT APPARATUS OF LINE-UP FREE TYPE

This application is a continuation, of application Ser. No. 08/191,261, filed Feb. 3, 1994, now abandoned.

BACKGROUND OF THE INVENTION

1. Field of the Invention

The present invention relates to a sheet post-treatment apparatus of a line-up free type in which the line-up can freely be effected, and more particularly, it relates to sheet treatment apparatus wherein output sheets on which images were formed by an image forming apparatus such as a copying machine and the like and which were discharged from the image forming apparatus can be treated by various post-treatments.

2. Related Background Art

Sheets (transfer materials) on which images were formed by an image forming station are normally used as they are. However, in some cases, regarding such sheets, various post-treatments such as sorting of sheets, stapling of sheets, folding of sheets and the like are performed. In the past, since the outlet of the image forming apparatus had a different height from the inlet of the output sheet treatment apparatus, the connection between these apparatuses was inconvenient.

SUMMARY OF THE INVENTION

An object of the present invention is to provide a sheet post-treatment apparatus of line-up free type in which the connection between output sheet treatment apparatuses can be freely effected.

The present invention provides a plurality of sheet convey or treatment apparatuses each of which has an inlet opening and an discharge opening for a sheet and/or sheet bundle, which inlet opening and discharge opening have the same hight.

With this arrangement, since the inlet opening and discharge opening of the output sheet treatment apparatuses have the same height with each other, it is possible to freely or conveniently connect one output sheet treatment apparatus to another output sheet treatment apparatus.

Further, the present invention also provides a sheet sort apparatus having at least two bins, wherein a sheet convey means can be arranged in place of any bin.

With this arrangement, when the sheet is conveyed through the sheet sort apparatus, without being sorted, to a next downstream treatment apparatus (for example, another sheet sort apparatus), the sheet is conveyed to a downstream side at a high speed by the convey means arranged in the sheet sort apparatus. Thus, the sheet conveying ability can be improved.

BRIEF DESCRIPTION OF THE DRAWINGS

FIG. 1 is an elevational sectional view of an image forming apparatus to which a sheet post-treatment apparatus according to the present invention is applied, and the sheet treatment apparatus including an output sheet treatment apparatus and the like;

DETAILED DESCRIPTION OF THE PREFERRED EMBODIMENTS

The present invention will now be explained in connection with embodiments thereof with reference to the accompanying drawings.

Figure 1:
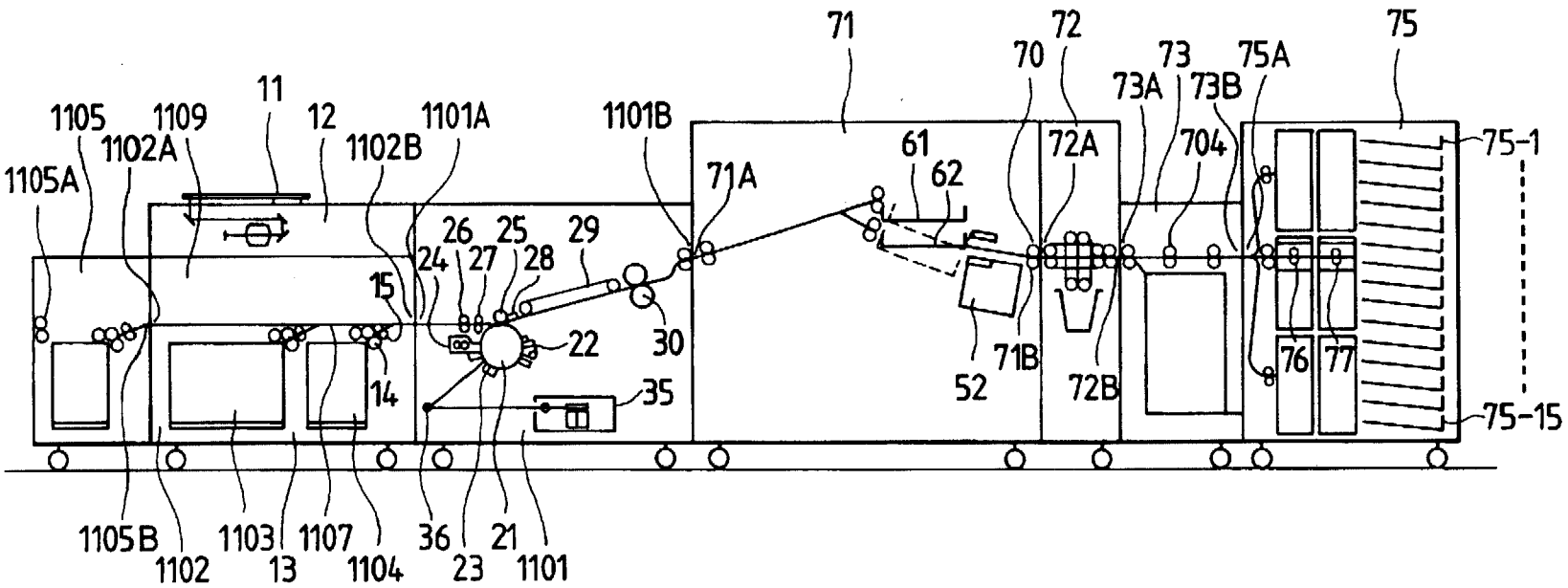

FIG. 1 is an elevational sectional view of an image forming and post-treatment system (apparatus) according to the present invention, including a body of an image forming apparatus, an input apparatus having a sheet supply portion and a reader portion connected to the image forming apparatus, and an output sheet treatment apparatus.

In FIG. 1, the input apparatus having the sheet supply portion and the upper reader portion is connected to the left end of the system. A frame 1102 of the sheet supply portion is formed independently from a frame 1101 of the body of the image forming apparatus. The sheet supply portion includes sheet supply decks 1103, 1104 each containing a number of sheets (transfer sheets), a sheet convey path 1107, sheet supply rollers 14 for feeding out the sheets, and convey rollers 15. The reader portion includes a pressure plate 11 for urging an original against a platen glass, and an optical system (reader) 12 for optically reading the original. Another sheet supply portion 1105 can be provided optionally.

As mentioned above, the frame 1101 of the image forming apparatus is independently formed from the frame 1102 of the sheet supply portion, and the frame 1102 contains therein a sheet supply mechanism and transfer sheet convey paths 1107, 1108. If the sheet is jammed, an operator retracts the frame 1102 of the sheet supply portion from the body of the image forming apparatus, with the result that he can remove the sheet jammed in the sheet supply portion.

Further, the frame 1102 of the sheet supply portion is divided into an upper frame 1109 and a lower frame which can be inserted into and retracted from the body of the image forming apparatus, respectively. In addition, the sheet supply decks 1103, 1104 can also be inserted into and retracted from the sheet supply portion independently.

A photosensitive drum 21 (as an image forming portion) is arranged at a downstream side of the sheet supply portion. Incidentally, the reference numeral 35 denotes a laser scanner for illuminating light onto the photosensitive drum 21 in response to image information from the optical system 12; 23 denotes a pre-charger; 24 denotes a developing device for forming a toner image; 26, 27 denote regist rollers; 25 denotes a transfer roller for transferring the toner image onto the sheet; 22 denotes a cleaner; 29 denotes a convey belt; and 30 denotes a fixing roller for fixing the transferred toner image onto the sheet.

A finisher 71 has a first intermediate tray 61 disposed at a downstream side of the sheet convey path, and a second intermediate tray 62. A binder 72 serves to adhere or bind an output sheet bundle (sent from the image forming portion) with adhesive. A stacker 73 serves to accommodate the output sheets. A sorter (sheet sort apparatus) 75 is provided with a plurality of bins for separating the output sheets.

First of all, the sheet convey apparatus (sorter) will be explained.

A twin carriage bundle convey apparatus has a size greater than the size of the sheet accommodated in the bin. The fundamental operation of the twin carriage bundle convey apparatus is disclosed in U.S. Pat. No. 4,900,009 issued on Feb. 13, 1990 (corresponding to the Japanese Patent Laid-open No. 63-262373).

Figure 2:
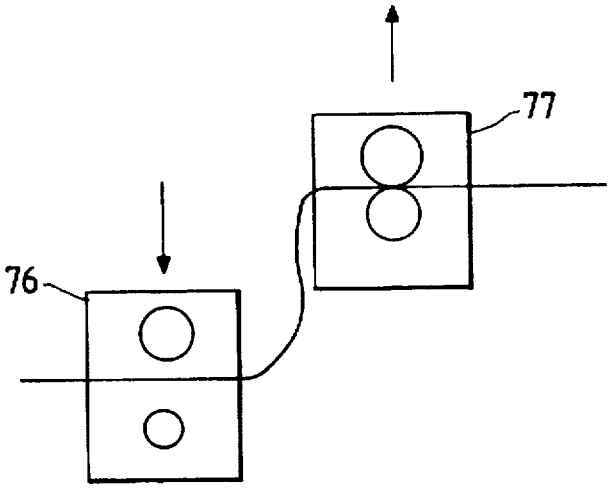
FIG. 2 is a side view of a carriage of a sorter (post-treatment apparatus) portion.

On the other hand, when the sheet are conveyed in a bundle, if carriages 76, 77 (FIG. 2) are moved independently, the sheet bundle cannot be passed through the carriages. Thus, upon the bundle convey, although the carriages must be moved simultaneously, when the sheets are bundled, since there is a sufficient distance between the sheet bundles, the productivity of the apparatus is not worsened. When a thickness of the sheet is small, the productivity superior to the conventional productivity during the pass-through can be reserved. In case of the sheet bundle, as shown in FIG. 1, the carriages 76, 77 are shifted upwardly or downwardly in a side-by-side relation to sort the sheet bundles in desired bin trays 75-1 to 75-15.

Next, a stapler unit of the output sheet treatment apparatus will be explained.

Figure 3:
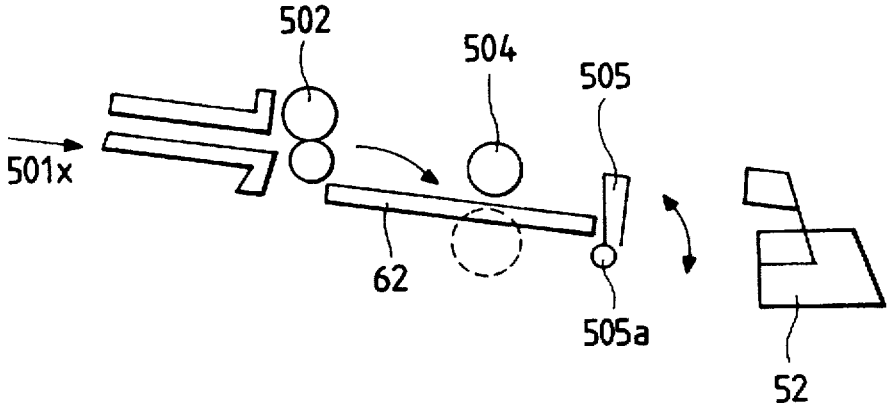
FIG. 3 is a side view of a stapler portion.

The transfer sheets P sent from a direction shown by the arrow 501*x* in FIG. 3 are stacked on a stacking tray 62 by inlet rollers 502. In this case, a skew-feed roller 504 abuts a lateral edge of the sheet against an abutment guide (not shown) to regulate the sheet in a widthwise direction. When a desired number of sheets are stacked on the tray, a stopper 505 is rotated around a fulcrum 505*a* to be retracted from the tray, with the result that the sheet stack is sent, by the roller 504, to a stapler 52 where the stacked sheets are stapled. The stapled sheet bundle is further conveyed by rollers 70.

Figure 4:
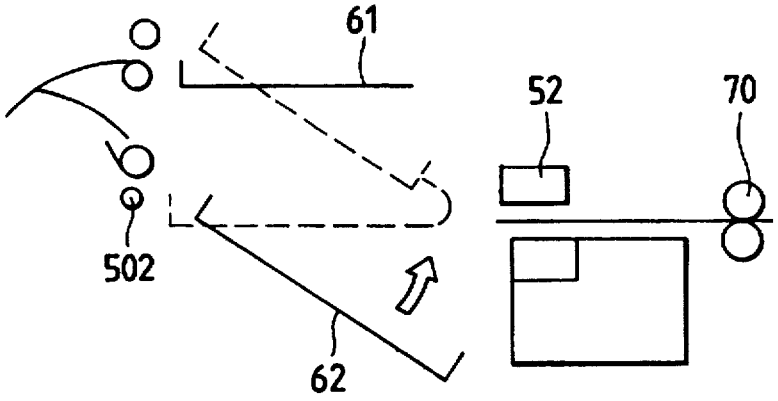
FIG. 4 is a side view of a stapler portion in an alternative form.

During the sheets are being stapled, when new sheets are fed continuously, since there is no place for accumulating the new sheet, an additional tray 61 is provided. When such trays are arranged as shown in FIG. 4, both trays can be connected to the stapler selectively only by rotating the tray.

In this case, since the positions of the trays in the proximity of the inlet rollers do not change, the output sheets can be accumulated continuously. Further, with this arrangement, even if the sheet is jammed in the stapler or in any device downstream of the stapler, since there are two trays, one of the trays can be used as an escape tray. That is to say, by accumulating the continuously sent sheets in the escape tray, it is possible to reduce the jam treatment space and jam treatment time.

Next, the adhering device of the output sheet treatment apparatus will be explained.

Figure 5:
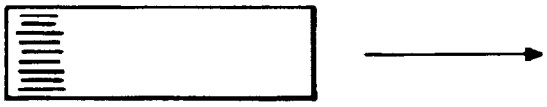
FIG. 5 is a side view of an output sheet bundle.
Figure 6:
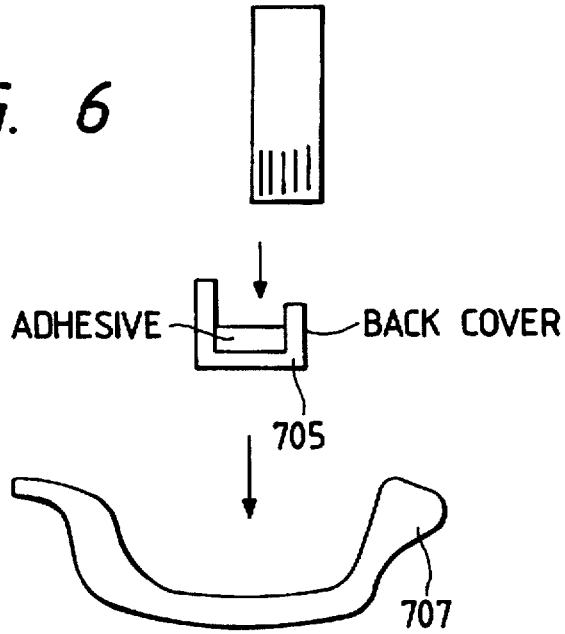
FIG. 6 is side view of an adhering device.

The sheet bundle is sent to the adhering device in parallel therewith (FIG. 5). However, the adhering operation can easily be performed in a vertical direction (FIG. 6). Thus, the non-stapled output sheet bundle must be rotated by 90 degrees (to change directions from lateral to longitudinal). Further, when the sheet bundle is discharged from the adhering device, since it is desirable, for the adjacent stacker and the like, to discharge the bundle from the lateral direction, it is necessary to rotate the sheet bundle by 90 degrees again (to change directions from longitudinal to lateral).

Figure 7:
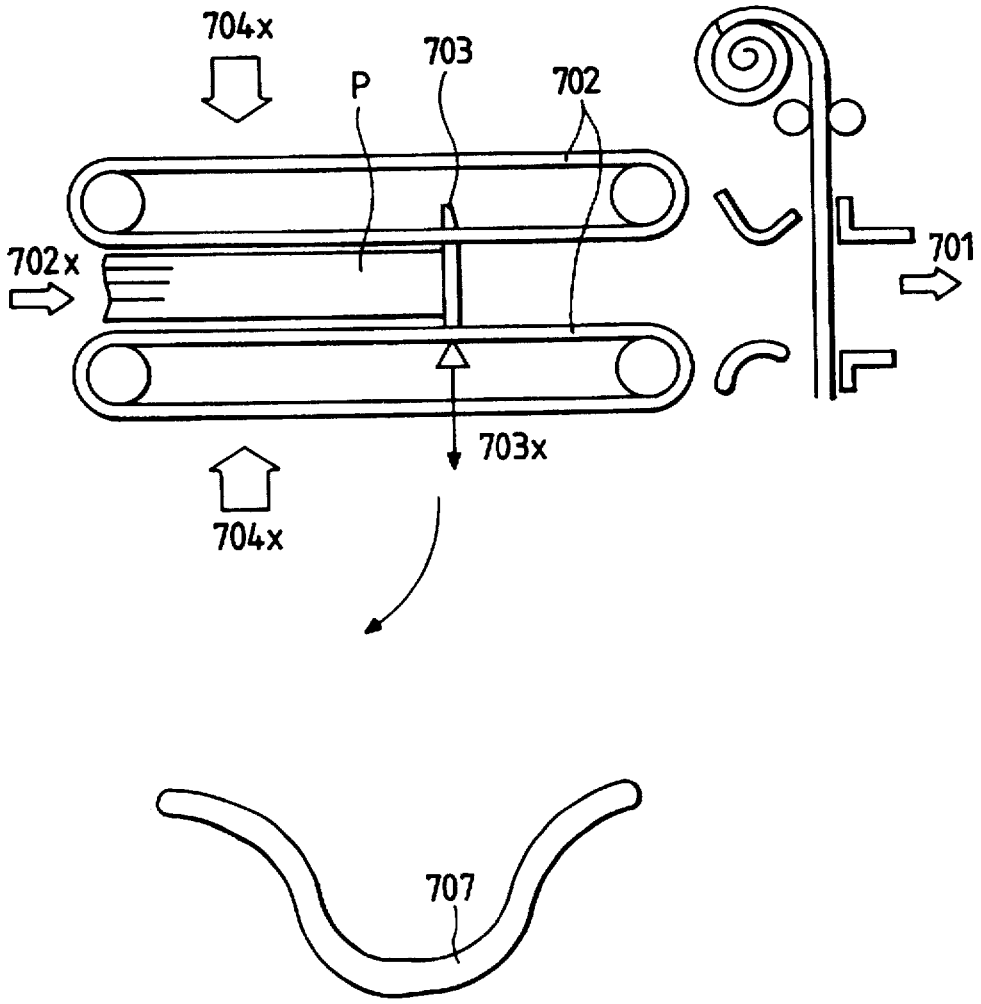
FIGS. 7 and 8 are side views of an adhering portion.

The non-stapled output sheet bundle P sent from a direction shown by the arrow 702*x* in FIG. 7 is pinched between a pair of convey belts 702 in which a distance therebetween can be freely changed. When the sheet bundle is abutted against a stopper 703 which can be retracted in a direction shown by the arrow 703*x*, the pair of convey belts 702 are stopped. The pair of belts 702 are pressurized in directions shown by the arrows 704*x* with appropriate pressure by a pressurizing mechanism (not shown). A drive mechanism for the pair of belts 702 is not shown.

Figure 8:
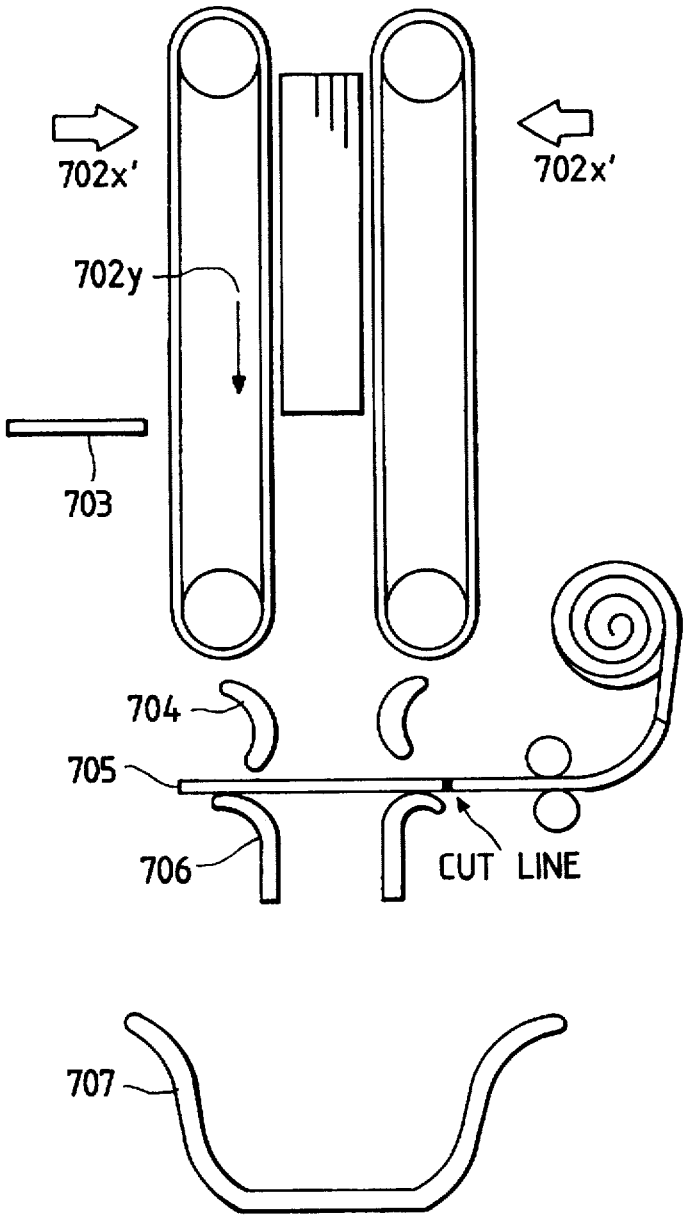

However, the pair of belts 702 can be shifted in a position shown in FIG. 8 by a linkage or a hinge mechanism; meanwhile, the direction of the output sheet bundle P can be changed from the lateral to longitudinal. In this case, the pair of belts 702 are further pressurized in directions shown by the arrows 702*x*' and at the same time the stopper 703 is retarded. Immediately after, the belts are rotated in directions shown by the arrow 702*y*.

Consequently, the sheet bundle is introduced between guides 704 to push an adhesive tape 705 (having an upper adhesive layer and a backing paper sheet) into guides 706. When the belts 702 are further rotated, the sheet bundle is seated in a heater 707 via the adhesive tape. When the adhesive is molten and is adhered to the sheet bundle, the pair of belts 702 are rotated reversely to return the sheet bundle P to the original position. When the sheet bundle is returned to the position shown in FIG. 7, the adhered sheet bundle is sent in a direction shown by the arrow 701.

Next, the sheet containing device (stacker) will be explained.

Figure 9:
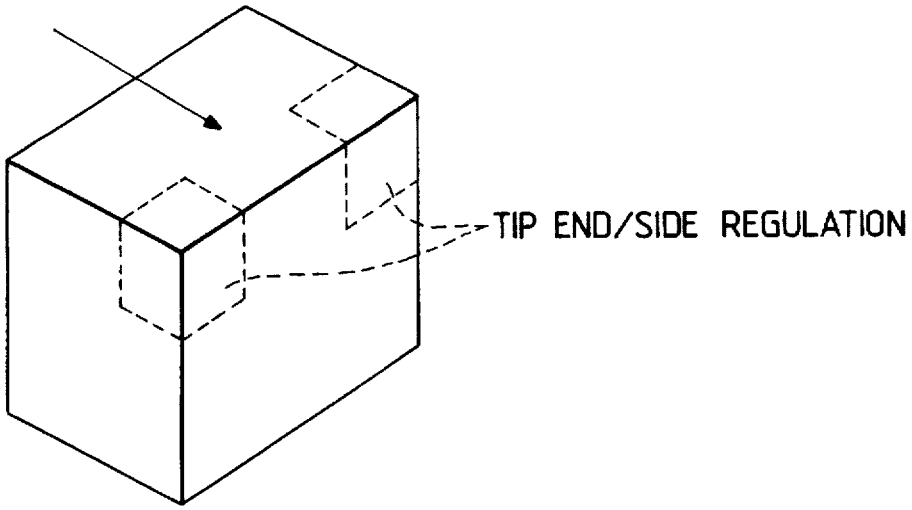
FIG. 9 is a perspective view of an end/side regulation member for a sheet.
Figure 10:
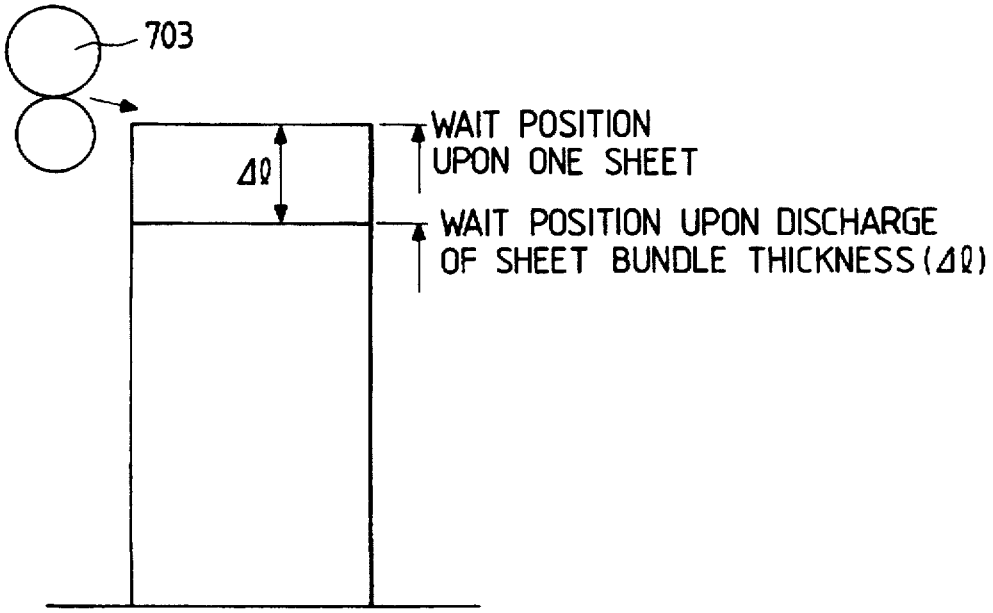
FIGS. 10 and 11 are side views of a stacker.
Figure 11:
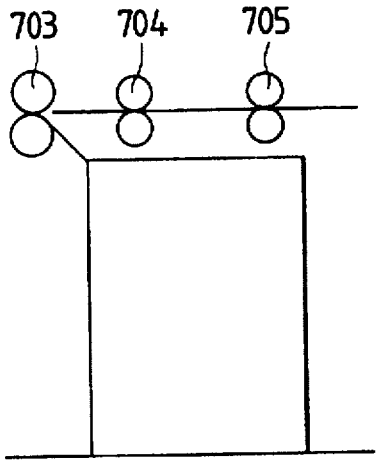

In FIGS. 9, 10 and 11, upon one sheet, the sheet is offset by the skew-feed roller and the like; whereas, upon the sheet bundle, the sheet bundle is offset by shifting discharge rollers 703 in a thrust direction.

However, if the above both cases try to be handled by a single offset mechanism, since (1) if the sheet (bundle) is thick the sheet cannot be offset by the skew-feed roller and (2) upon one sheet, if the discharge rollers are shifted in the thrust direction the time will be too short to complete the offset, both offset means should be switched in accordance with the one sheet or the sheet bundle.

Next, a bundle convey/one sheet convey permitting path will be explained.

Figure 12:
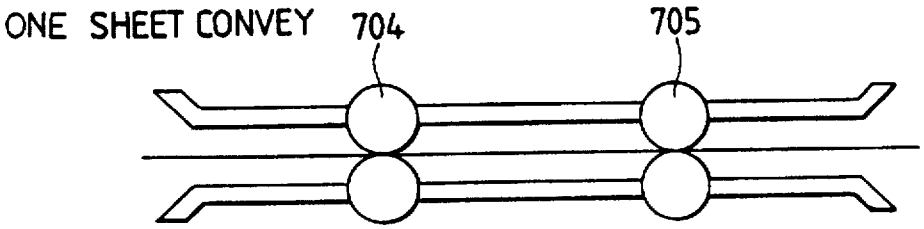
FIGS. 12 and 13 are side views of convey rollers of the stacker.
Figure 13:
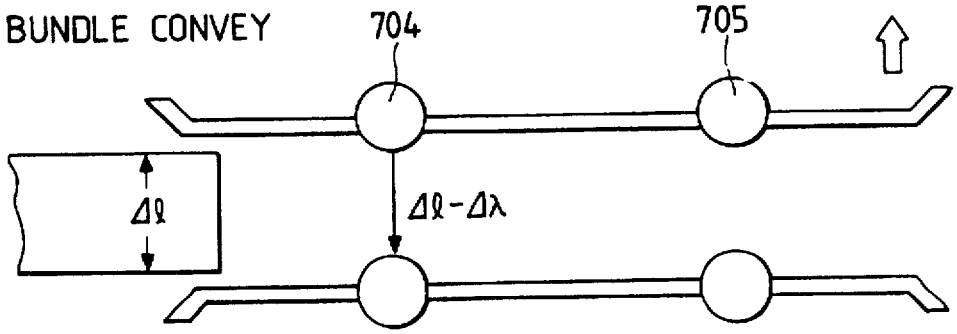

FIG. 12 shows the convey path when one sheet is conveyed, and FIG. 13 shows the convey path when the sheet bundle is conveyed. Upon the bundle convey, the upper guide is shifted upwardly as well as the upper convey rollers 704, 705.

If a diameter of each convey roller is great, since the convey path will be also wider accordingly, thereby causing the incovenience upon one sheet convey, the diameter of each convey roller is preferably small.

Next, the connection path will be explained.

Figure 14:
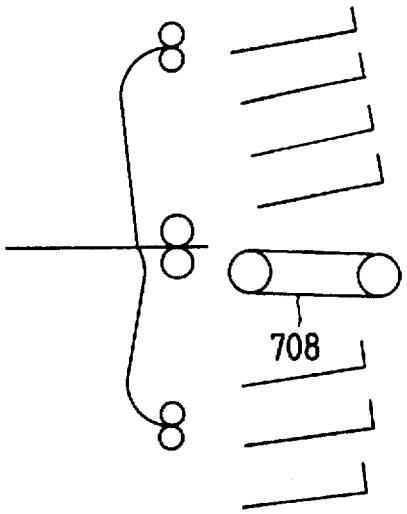
FIG. 14 is a side view of a connection path portion of the sorter (post-treatment apparatus)

FIG. 14 shows the connection path for conveying the sheet to the sheet sort device. The connection path has a plurality convey paths for sorting the sheets (transfer sheets) to a plurality of bins. Among these convey paths, a central convey path includes a straight path 708. The straight path 708 comprises a pair of rollers and a convey belt and is connected to an upstream sort path (straight path) having the highest bundle conveying ability. With this arrangement, as shown in FIG. 15, it is possible to additionally arrange an additional sorter 175 at an upstream side of the first sorter (FIG. 1).

When the conveyed sheets are not sorted in the front (additional) sorter 175, unless the sheet or the sheet bundle is passed through the front sorter quickly, it is feared that the treatment of the next sheet is impeded. This embodiment (FIG. 15) provides a sheet sort device which can convey the sheet at a high speed to improve the ability of the device when the sheet is conveyed quickly without being sorted in the front sorter.

Figure 15:
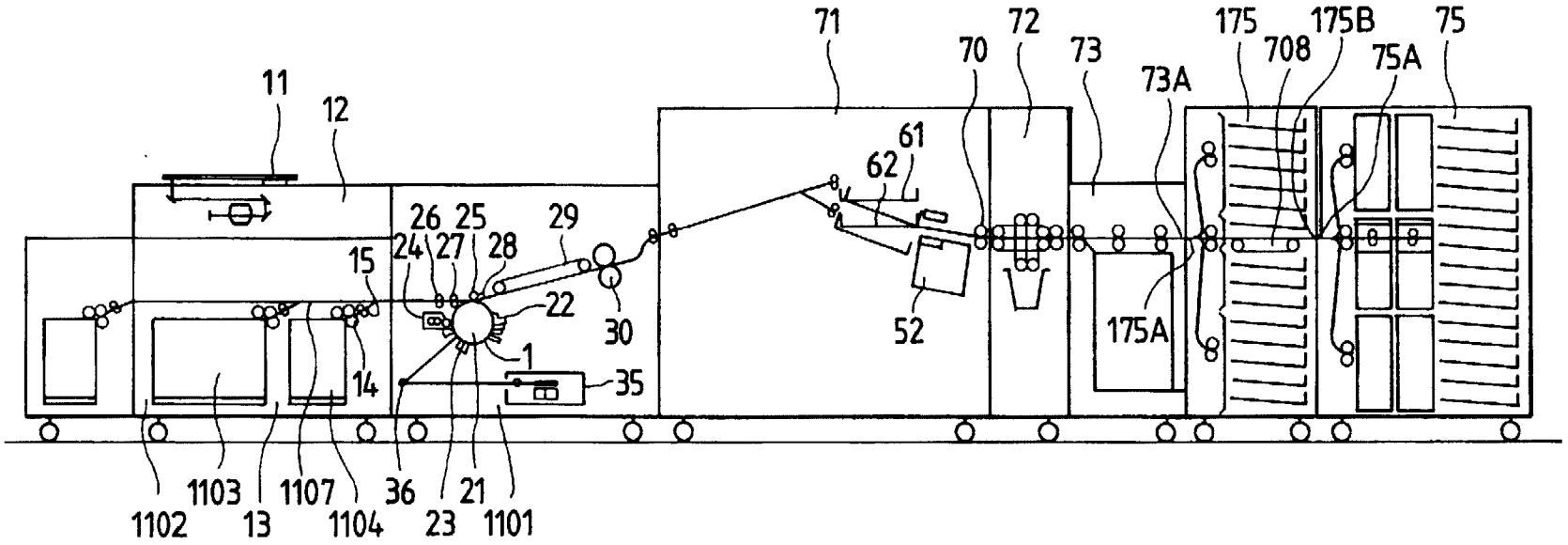
FIG. 15 is an elevational sectional view similar to FIG. 1, but incorporating the connection path portion of FIG. 14 therein.
Figure 16:
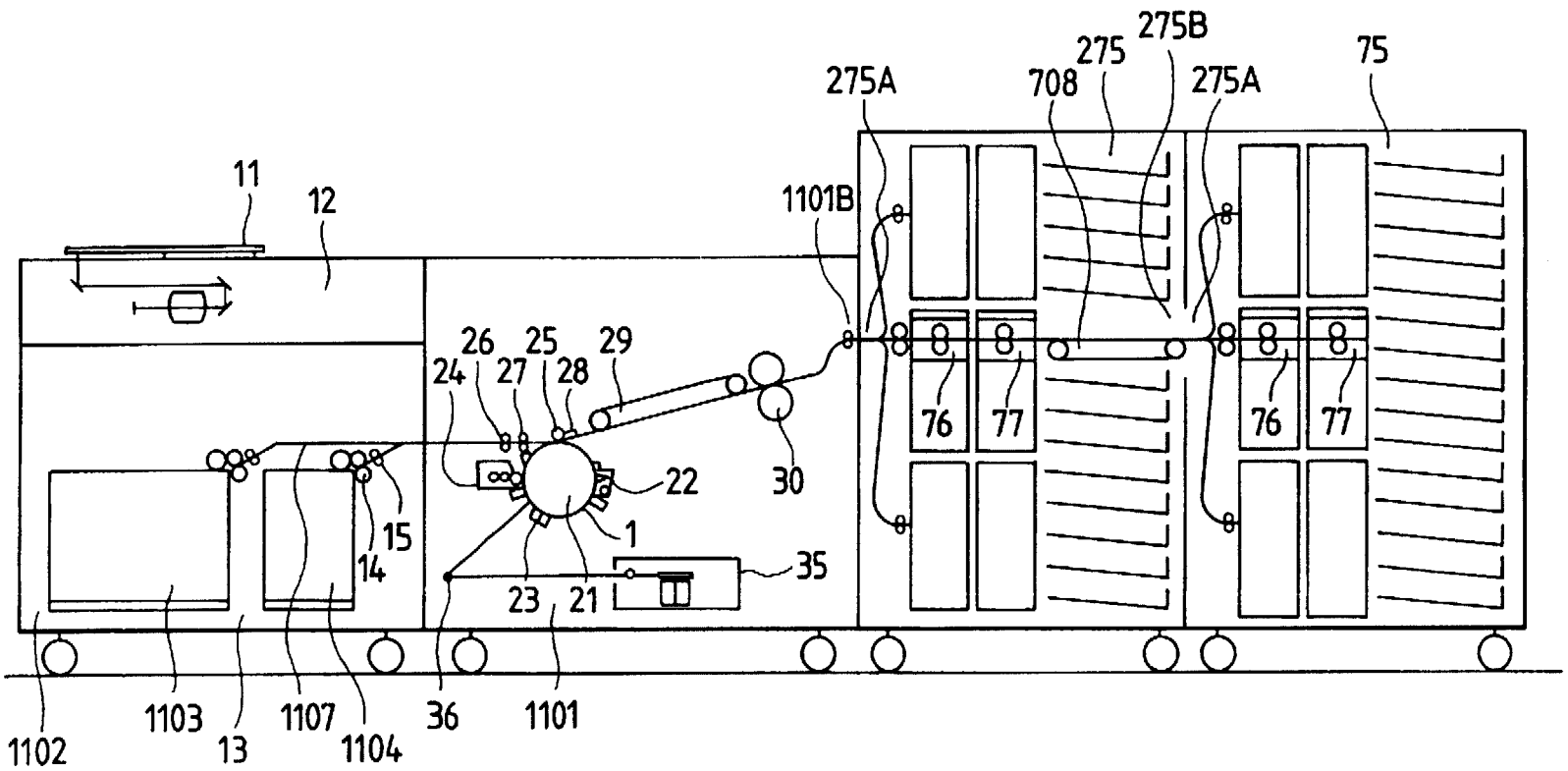
FIG. 16 is an elevational sectional view of an image forming and post-treatment apparatus, to which, in place of a finisher, binder and stacker of FIG. 1, another sorter having a connection path portion is connected.

FIG. 16 shows an alteration of the embodiment of FIG. 15. In this alteration, an additional sorter 275 having a straight path (convey belt) 708 between the bin trays is directly arranged between the image forming apparatus and the sorter 75 of FIG. 1.

Figure 17:
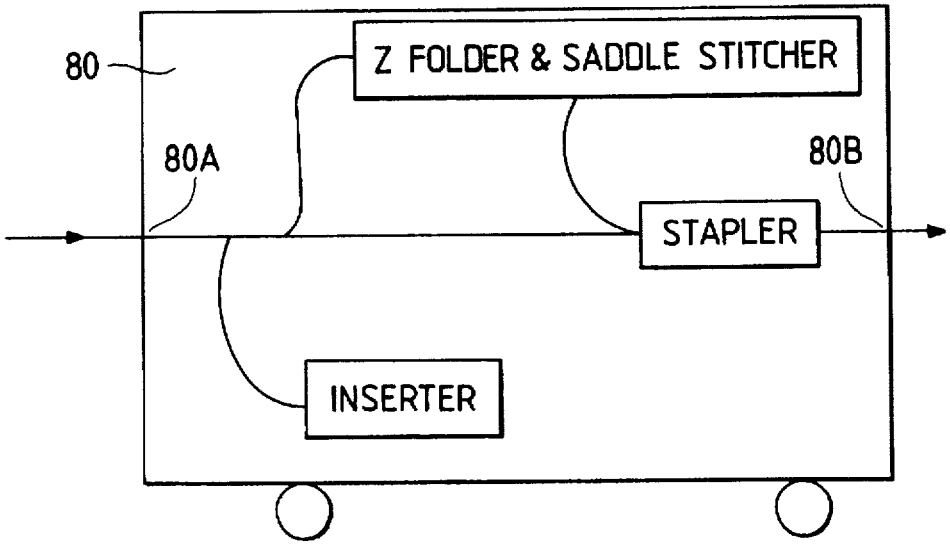
FIG. 17 is a schematic view of an output sheet treatment apparatus according to the present invention having a plurality of output sheet treatment portions.

FIG. 17 is a schematic view of an output sheet treatment apparatus wherein the arrangement between a plurality of treatment mechanisms is improved. By arranging a Z-folder, saddle sticher, stapler and inserter as shown in FIG. 17, it is possible to discharge the sheet or the sheet bundle from a single exit opening, thereby facilitating the treatment of the discharged sheet. Incidentally, the inserter serves to supply sheets having different colors to sort them.

Figure 26:
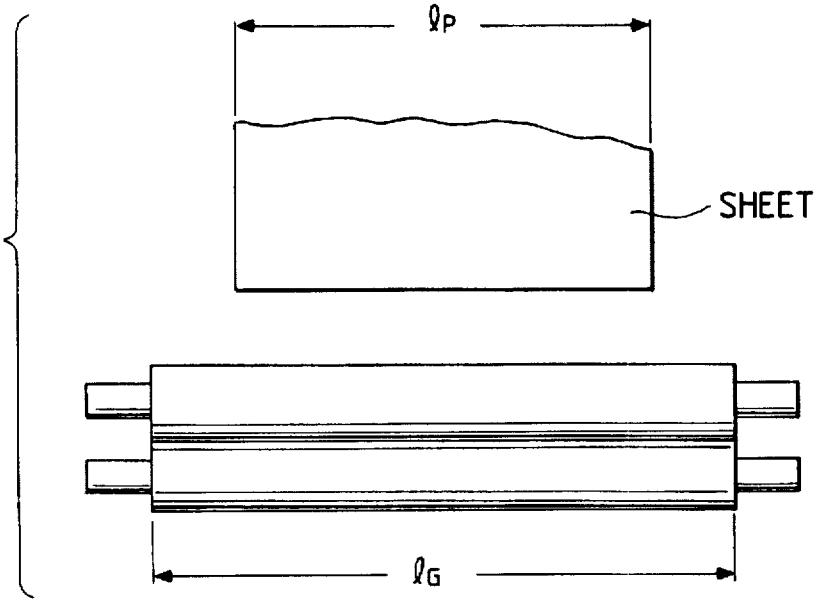
FIG. 26 is a front view of a pair of rollers of a sheet folding portion.
Figure 27:
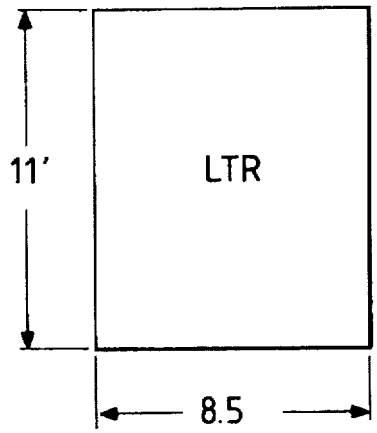
FIGS. 27 to 29 are plan views of a sheet to be folded.
Figure 28:
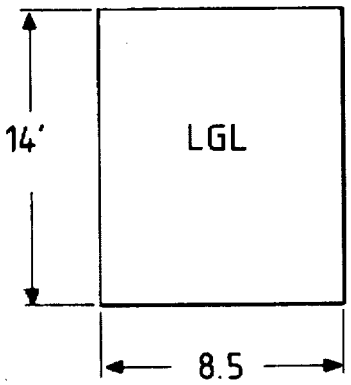
Figure 29:
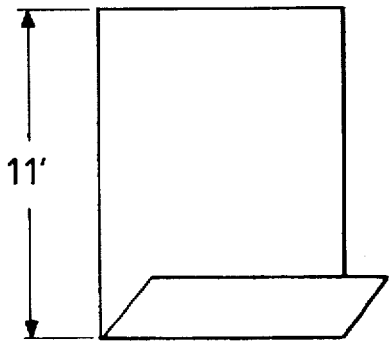
Figure 30:
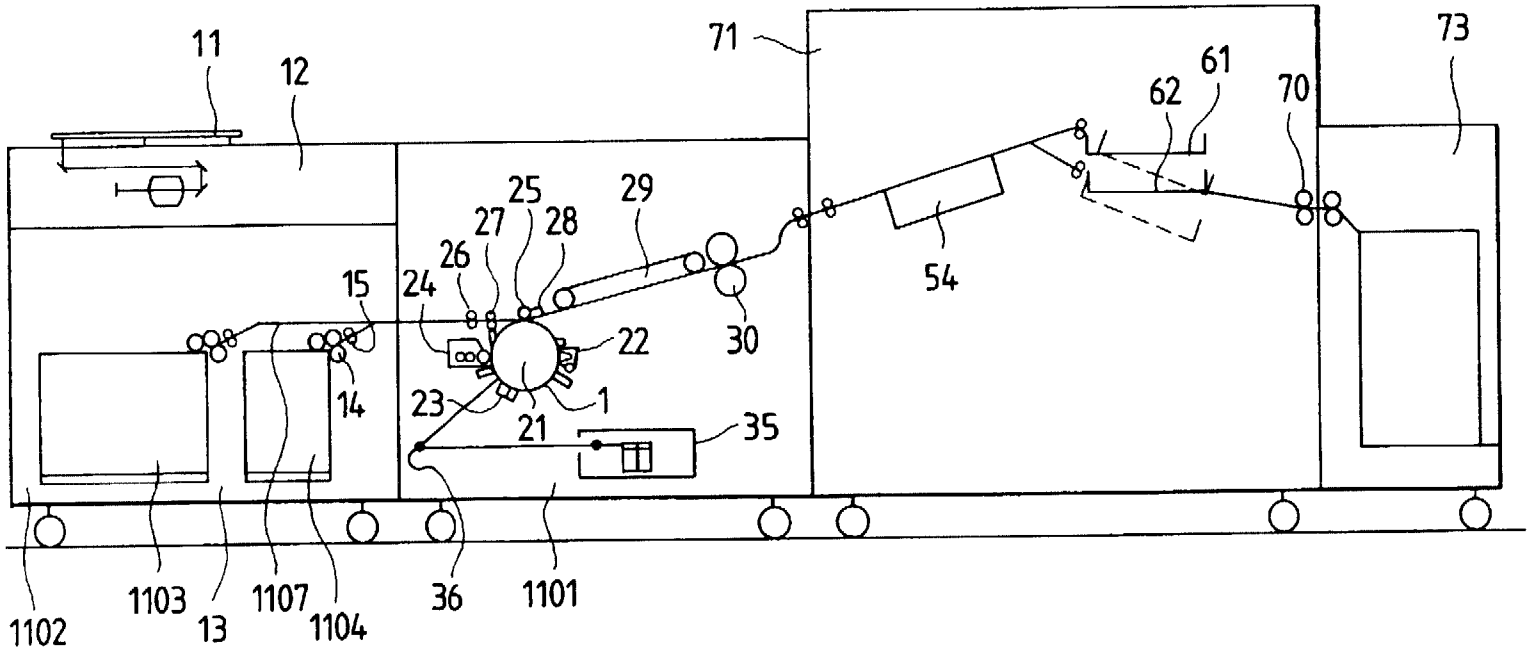
FIG. 30 is an elevational sectional view of an image forming and post-treatment apparatus having post-treatment apparatuses including a tab trimmer, a stacker and a body of an image forming apparatus.

In the output sheet treatment apparatus 80 according to the present invention, (1) a pair of rollers 209 which will be described later in connection with the saddle sticher and (2) a pair of rollers 214, 215 which will be described later in connection with the Z-folder have lengths greater than the width of the sheet (lG>lP in FIG. 26) and the abutment force between the rollers is great.

Now, the saddle sticher will be explained.

Figure 18:
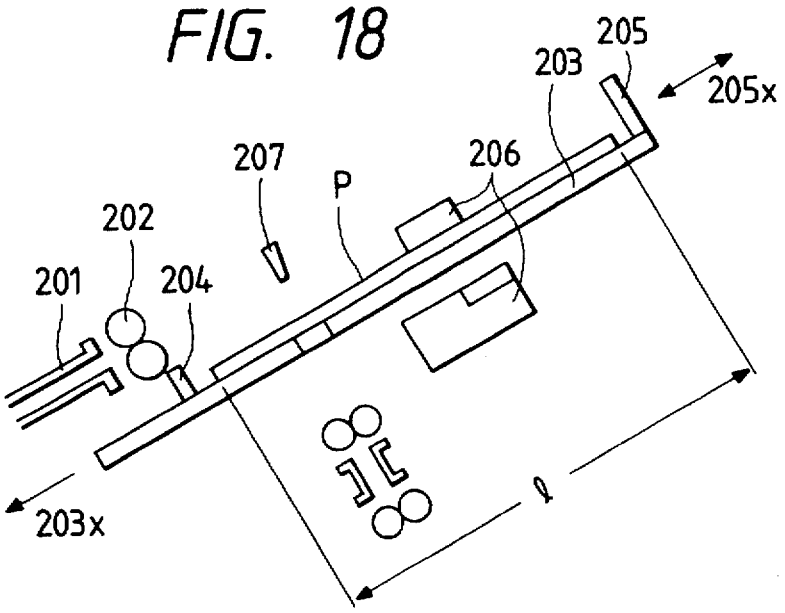
FIG. 18 is a side view of a saddle sticher portion.
Figure 19:
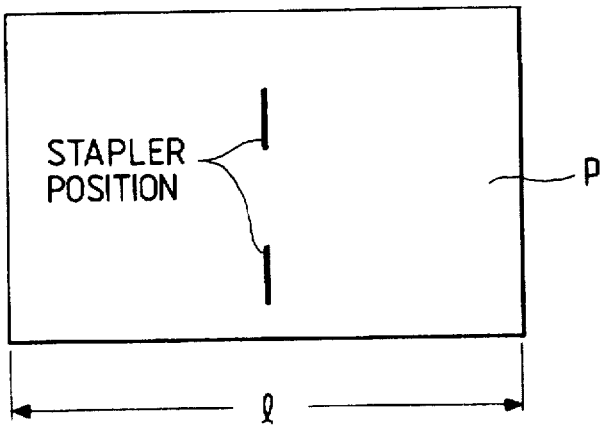
FIG. 19 is a plan view of a sheet to be stapled.

The transfer sheet P (FIG. 18) passed through a paper guide plates 201 is sent to a pair of discharge rollers 202. After the sheet leaves the discharge rollers 202, it is rested on a sticher tray 203. A stapler 206 is disposed at a position corresponding to a middle (l/2) of the length l of the stacked sheets regulated by a paper stopper 204 and a regulating plate 205 for arranging the sheets by shifting in directions shown by the arrow 205*x*, so that the sheets are stapled at positions shown in FIG. 19.

Figure 20:
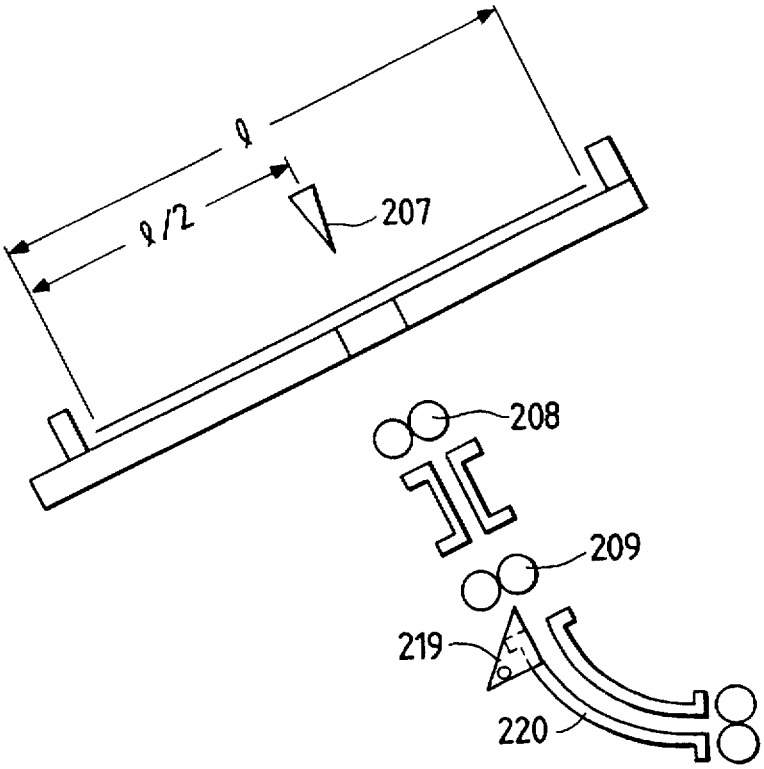
FIG. 20 is a side view of the saddle sticher.
Figure 21:
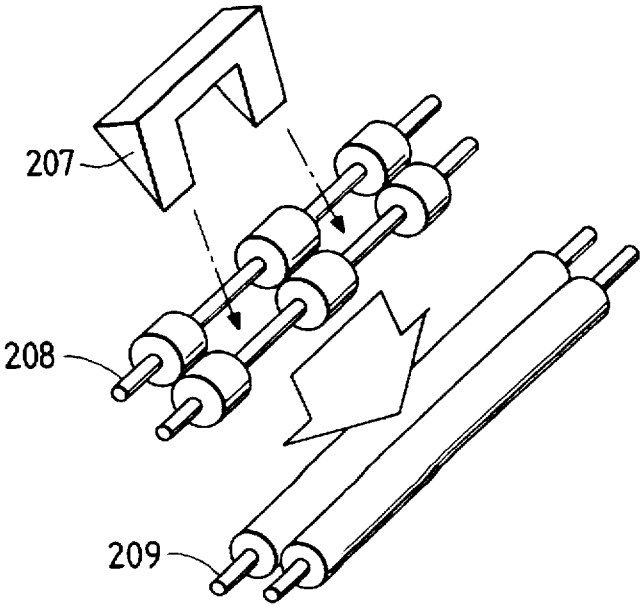
FIG. 21 is a perspective view of the saddle sticher.

Thereafter, the sticher tray 203 is shifted in a direction shown by the arrow 203*x* until the stapled positions on the sheets P reach just below a saddle knife 207 (FIG. 20). The saddle knife 207 and folder rollers 208, 209 are constituted and arranged as shown in FIG. 21. That is to say, each folder roller 208 comprises a plurality of rubber roller portions mounted on a corresponding shaft and spaced apart from each other along the shaft, and the saddle knife can enter into spaces between the rubber roller portions (to effect the provisional folding). On the other hand, each folder roller 209 comprises a solid rubber roller having a length greater than the width of the sheet and the urging (abutment) force between the folder rollers 209 is considerably greater than the urging force between the folder rollers 208, so that the transfer sheets P can be completely saddle-folded by these folder rollers 209.

Next, the Z-folder will be explained.

Figure 22:
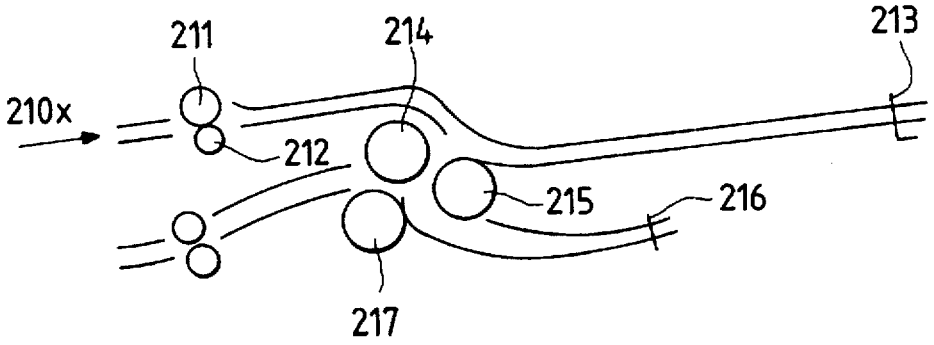
FIGS. 22 to 25 are side views of a Z-folding portion.
Figure 23:
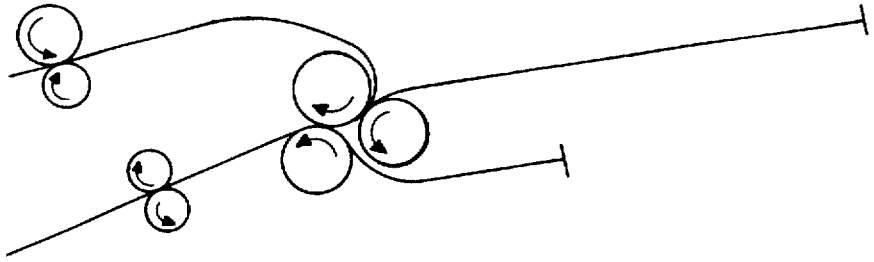

The transfer sheet P sent from a direction shown by the arrow 210*x* in FIG. 22 (rotational direction of rollers 211, 212 in FIG. 23) is passed through between the rollers 211, 212 and then is conveyed until the sheet is abutted against a stopper 213. Only for the explanation's sake, it is assumed that a sheet having A3 size is Z-folded to a sheet having A4 size. Thereafter, a loop is formed in the transfer sheet P having A3 size in a space in the path 211. (A distance between the rollers 211, 212 and the stopper 213 is set to be smaller than a length l (=420 mm) of the sheet having A3 size, and a distance between paired rollers 214, 215 and the stopper is set to be ¾ of the length of the sheet having A3 size.)

Figure 24:
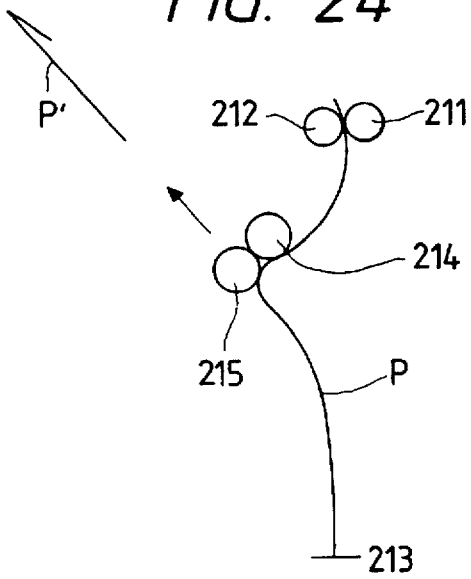

The transfer sheet P assumes the shape as shown in FIG. 24 and is contacted with the pair of rollers 214, 215. In this condition, the transfer sheet P is pulled by the pair of rollers 214, 215, with the result that, when the transfer sheet leaves the paired rollers 214, 215, ¼ portion of the transfer sheet P' having A3 size was folded.

Figure 25:
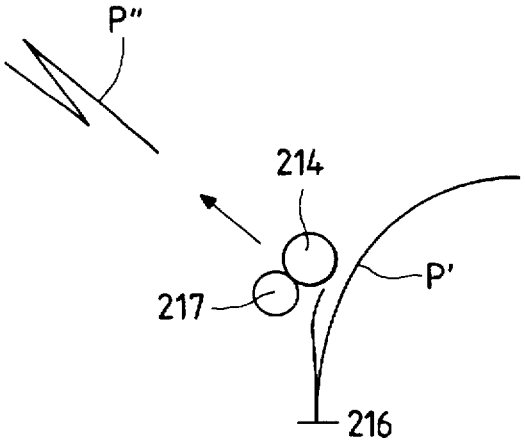

Thereafter, the folded portion of the transfer sheet P' is abutted against a stopper 216 and then is further pulled by a pair of rollers 214, 217 to obtain a Z-folded transfer sheet P" (FIG. 25). In this case, the folder rollers 214, 215, 217 have lengths greater than the width of the sheet and the urging forces between the rollers 214, 215 and between the rollers 214, 217 are great enough, so that the transfer sheet P can be completely folded.

Next, the tab trimmer 54 of the output sheet treatment apparatus will be explained.

Figure 31:
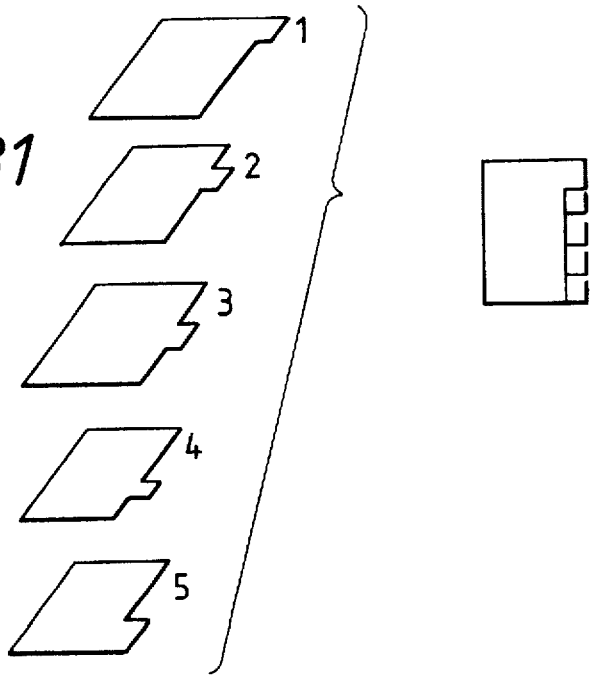
FIG. 31 is a perspective view of tab sheets.

In the past, in order to supply the sorted sheets to a copying machine or a printer, each sheet was provided with a tab as shown in FIG. 31. Further, since the length of the tabs were fixed or inherent, (in FIG. 31, one set consists of five tab sheets) if the fewer sorted sheets were required to use, the remaining tab sheets were thrown away (for example, when three sorted sheets were used, the remaining two tab sheets were not required).

Figure 32A:
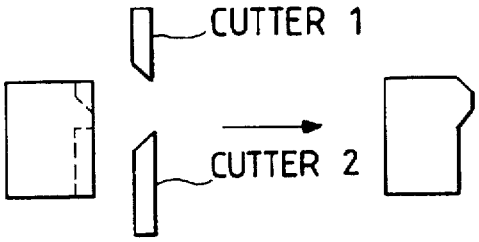
FIGS. 32A and 32B are plan views of a sorted sheet and cutters.
Figure 32B:
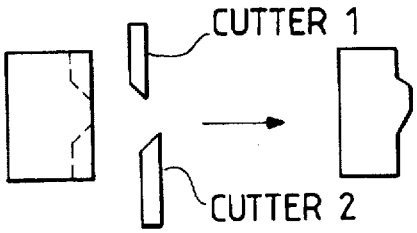

By providing cutters 1, 2 movable in an up-and-down direction (as shown in FIG. 32) in the output sheet treatment apparatus, it is possible to obtain the sorted sheets having tabs of any lengths, thereby avoiding waste of sheets and the necessity of preparation of special tab sheets.

Figure 33:
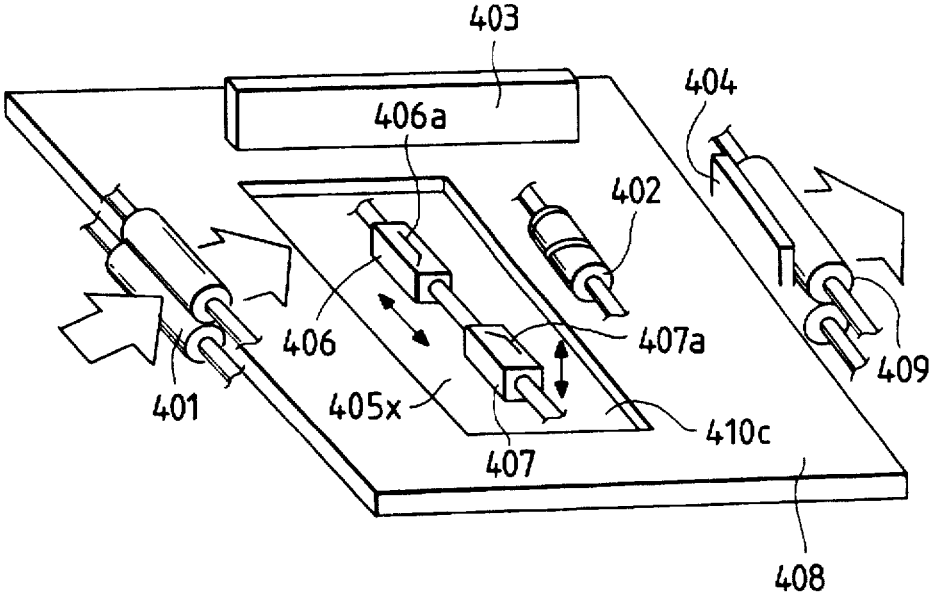
FIG. 33 is a perspective view of a tab trimmer device.

In FIG. 33, the transfer sheet P passed through a pair of inlet rollers 401 is conveyed by a skew-feed roller 402 until it is abutted against a retractable stopper 404 while being guided by a stopper 403. Then, the transfer sheet P is cut by replaceable cutter blades 406*a*, 407*a* removably attached to cutter supports 406, 407 shiftable in directions shown by the arrow 405*x*, thereby forming a tab in the transfer sheet. That is to say, the cutter supports 406, 407 can be also moved in a directions shown by the arrow 410*c*, and, when the cutter supports are moved upwardly, the transfer sheet is press-cut between the cutter blades and an anvil (not shown). After the cutting, the stopper 404 is retarded below a paper guide 408, and then the transfer sheet is conveyed again by the skew-feed roller 402 and a pair of outlet rollers 409.

Figure 34:
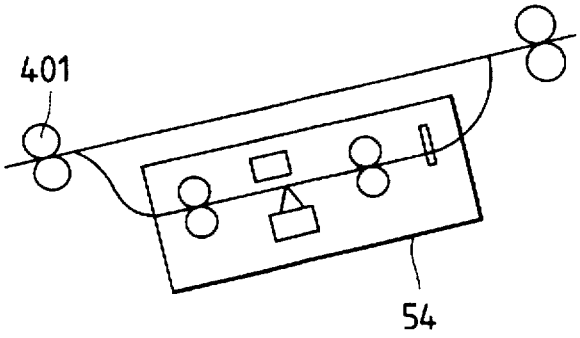
FIG. 34 is a side view of the tab trimmer.
Figure 35:
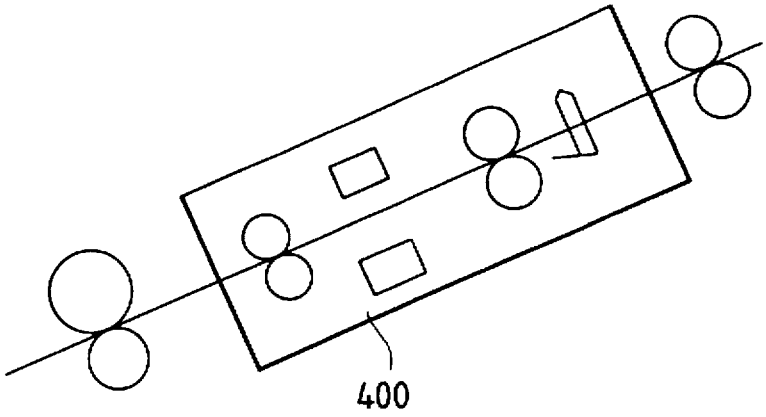
FIG. 35 is a side view of a tab trimmer according to another embodiment.

FIG. 35 shows an example that a tab trimmer 400 is arranged in a main path, unlike the case where the tab trimmer 54 is arranged in a by-pass path as shown in FIG. 34.

Next, the tab trimmer will be explained in detail.

The tab sheets are set on either of the sheet supply decks 1103, 1104 of the sheet supply portion of FIG. 1, and a tab sheet set completion button informing of the fact that the tab sheets are set is depressed. Alternatively, an additional sheet supply deck exclusively used for tab sheets may be provided and when the tab sheets are set a "tab sheet presence" signal may be emitted. Now, each tab sheet comprises a sheet material slightly greater than the normal transfer sheet so that the tab portion is protruded.

During the image forming operation is being effected, in the course of the sheet being stacked on the tray 62 of the stapler, when a tab signal is inputted from a control device (CPU) at a predetermined timing (after a predetermined number of sheets), the tab sheet is supplied. In the tab trimmer 54, the tab sheet is cut to form a tab having an appropriate length. After the cutting, the tab sheet is stacked on the normal sheets.

Thereafter, the image forming operation is started again and the normal sheet is stacked on the tab sheet on the tray 62. Similarly, when the tab signal is inputted again, the next tab sheet is supplied. In this way, the sheet bundles divided by the tab sheets are obtained.

Such sheet bundle is sent to the stapler, where the sheet bundle is stapled. In this way, the sheet bundles divided by a plurality of tab sheets are completed. Thereafter, the sheet bundles may be sent to an appropriate post-treatment apparatus, where the sheet bundles are subjected to the post-treatment (such as adhering, sorting).

According to the tab trimmer device of the illustrated embodiment, the tabs are formed in the tab sheets in offset positions as shown by 1, 2, 3, 4, 5 (FIG. 31) from the above, and, when additional tab sheets are required, the tabs are formed in the additional tab sheets in offset positions similarly.

When the sheet bundles divided by the plural tab sheets are completed, a tab memory is cleared. When the formation of new sheet bundles is started, new tabs are formed in new tab sheets in offset positions as shown by 1, 2, 3, 4, 5 (FIG. 31) from the above.

Next, the inlet and outlet will be explained.

As mentioned above, by arranging the transfer sheet/sheet bundle inlet openings 71A, 72A, 73A, 75A, 80A, 175A, 275A and the sheet/sheet bundle outlet openings 71B, 72B, 73B, 75B, 80B, 175B, 275B of the plurality of copy sheet treatment apparatuses (stapler, binder, stacker, sorter and additional sorter) connected to the image forming apparatus such as the copying machine, printer and the like at the same height, it is possible to freely combine various treatment apparatus (FIGS. 15 and 16). Further, by arranging the sheet discharge opening of the image forming apparatus at the same height as the inlet openings of the treatment apparatuses, the image forming apparatus can be combined with any treatment apparatus (for example, image forming apparatus and stacker, or image forming apparatus and sorter).

Further, by arranging the inlet openings 1102A, 1105A and the discharge openings 1102B, 1105B of the sheet supply apparatuses at the same height, the sheet supply apparatuses can freely be connected to each other, and, by arranging these openings at the same height as the transfer sheet inlet opening 1101A of the image forming apparatus, the sheet supply apparatuses can freely be combined with the image forming apparatus.

The finisher, binder, stacker and sorters are copy sheet treatment apparatuses having independent frames, and, since the inlets and outlets of these apparatuses have the same heights, various combination (for example, no binder, single stage stacker, no sorter or the like) can be achieved. The sheet supply apparatuses can also be combined. Particularly, not only the alteration of the combination but also the replacement of the orders can easily be effected. These features are called as "line-up free".

Lastly, the registration mechanism will be explained.

Figure 36:
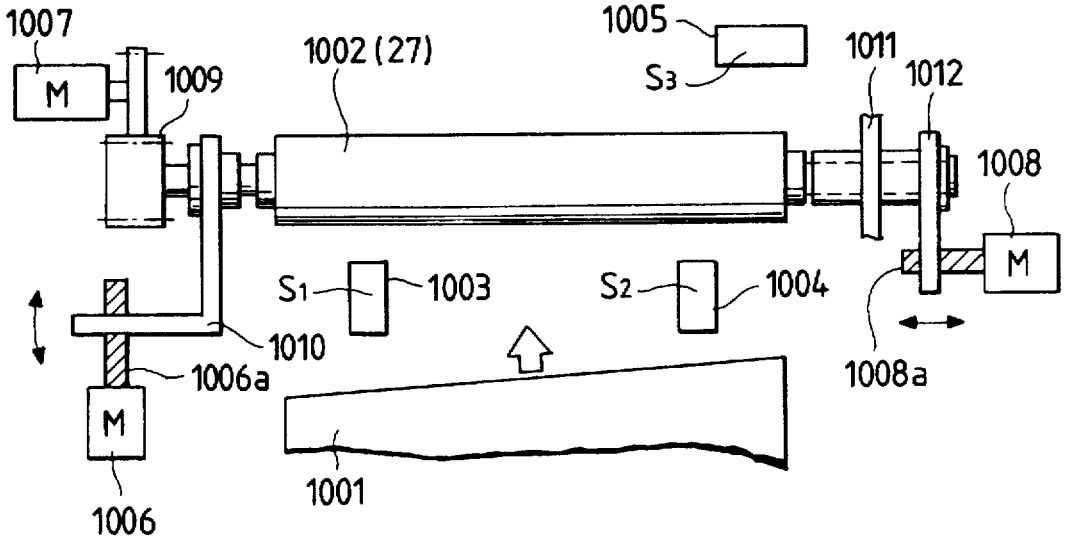
FIG. 36 is a plan view of a registration device.
Figure 37A:
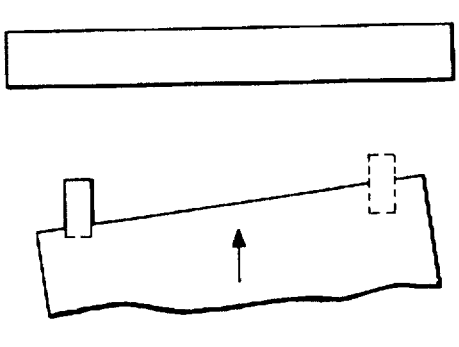
FIGS. 37A to 37E are views showing the operation of the registration device.
Figure 37B:
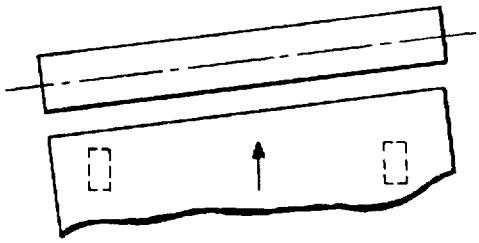
Figure 37C:
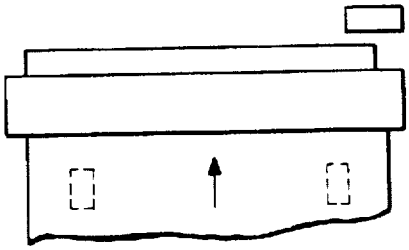
Figure 37D:
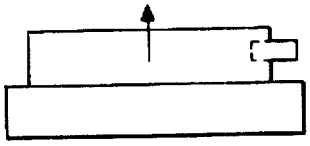
Figure 37E:
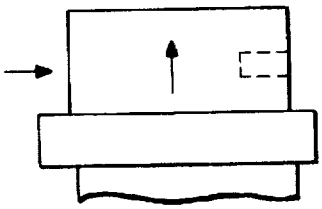
Figure 38:
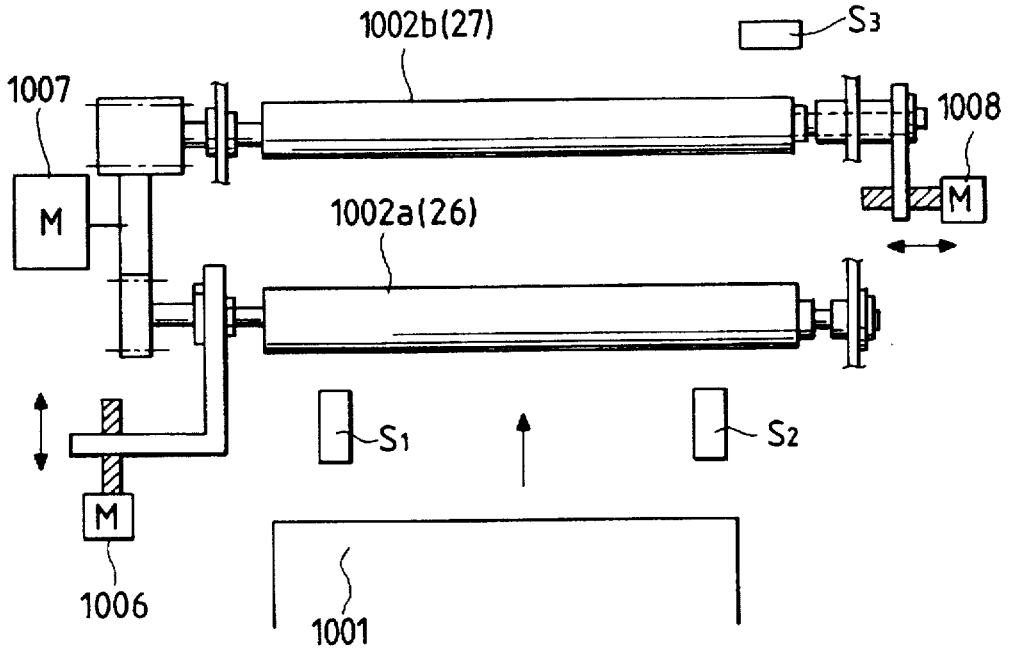
FIG. 38 is a plan view of a registration device according to another embodiment.

FIGS. 36 to 38 show the registration mechanism 27 of FIG. 1 in detail.

In FIG. 36, the transfer sheet 1001 is sent from a direction shown by the arrow. A pair of convey rollers 1001 (27) are supported by a frame 1011 and a support plate 1010. Sensors 1003, 1004 are arranged in front of the pair of convey rollers 1002 so that the sensors are oriented to a direction perpendicular to a transfer sheet convey direction. A motor 1006 is attached to the support plate 1010 by a screw 1006A. Further, gears 1009 are secured to one ends of the paired convey rollers 1002, which gears are meshed with a motor gear of a motor 1007 so that the rollers are rotated by the motor 1007.

A bearing 1012 is mounted on the other ends of the rollers 1002 so that there is substantially no play in the thrust direction with respect to the rollers 1002, which bearing is connected to a motor 1008 via a screw 1008A. Further, at a downstream side of the paired rollers 1002, there is arranged a CCD sensor 1005 for detecting an end of the transfer sheet 1001.

Explaining the operation of the registration mechanism with reference to FIGS. 37A to 37E, the inclination of the tip end of the transfer sheet 1001 is detected by the sensors 1003, 1004. On the basis of the inclination calculated by a calculation mechanism (not shown), the pair of rollers 1002 are rotated around a rotational center (not shown) by the motor 1006 so that the nip between the rollers 1002 becomes parallel with the tip end of the advanced transfer sheet (Of course, this operation is effected before the transfer sheet 1001 enters into the nip between the rollers 1002).

After the transfer sheet 1001 enters into the nip between the rollers 1002, the motor 1006 is rotated to shift the rollers 1002 so that the nip is directed to a direction perpendicular to the correct transfer sheet convey direction. Since the transfer sheet is pinched between the rollers 1002, the transfer sheet is also directed to the direction perpendicular to the correct transfer sheet convey direction. Depending upon the shifting direction of the rollers, although the transfer sheet must be pulled slightly in the convey direction, in such a case, the transfer sheet may be loosened by making the rotating speed of the rollers slower slightly.

Further, when the transfer sheet 1001 is advanced, the tip end of the transfer sheet 1001 is detected by the sensor 1005.

The sensor 1005 is preferably a CCD sensor. On the basis of the widthwise position of the detected transfer sheet, the shifting amount of the rollers 1002 is calculated by the calculation mechanism (not shown), and the motor 1008 is driven. The screw 1008A is rotated by the rotation of the motor 1008 to shift the bearing 1012 and the rollers 1002 in the thrust direction. In this way, the thrust position of the transfer sheet is corrected. Further, on the basis of the timing that the tip end of the transfer sheet passes across the sensor 1005, the deviation of the transfer sheet in the convey direction with respect to the image formed in the image forming portion is calculated, and, by controlling the rotational speed of the motor 1007 appropriately, such deviation is corrected.

A series of the above operations can be effected without stopping the rotation of the paired rollers 1002. Thus, the registration mechanism is effective to the high speed transfer sheet conveyance, and apparatuses having digital light signal image forming means (laser, LED array) and having a transfer sheet feed mechanism wherein a distance between the conveyed transfer sheets is short.

FIG. 38 shows another embodiment of a registration mechanism wherein the inclination of the transfer sheet is corrected by a pair of rollers 1002*a* (27) and the thrust position of the transfer sheet is corrected by a pair of rollers 1002*b* (26) disposed at a downstream side of the rollers 1002*a*. With this arrangement, this registration mechanism 26, 27 can easily be applied to apparatuses in which a transfer sheet having a small length is conveyed at a high speed.

What is claimed is:

1. A sheet treatment apparatus, comprising a first, a second, and a third sheet treatment unit, characterized by that:

each of said first, second, and third sheet treatment units have different kinds of sheet treatment functions, and each of said first, second, and third sheet treatment units has at both sides thereof substantially fixed openings at substantially the same height for discharging or receiving the sheet, so that a sheet is conveyed in one direction from the front most sheet treatment unit to the rearmost sheet treatment unit through the intermediate sheet treatment unit, among the first to third sheet treatment units in arbitrary sequence, or from the front most sheet treatment unit directly to the rearmost sheet treatment unit selected from said first to third sheet treatment units, wherein one of said first to third sheet treatment units is a sorter comprising (i) a plurality of bin trays separately arranged in a vertical direction between said sheet receiving opening and said sheet discharging opening, (ii) a straight path extending generally straight between and connecting said sheet receiving opening and said sheet discharging opening, and (iii) sheet carry means for carrying the sheet from said sheet receiving opening by a vertical movement along said bin trays and discharging the sheet to said bin trays, said sheet carry means also constituting a portion of the straight path when the sheet is discharged to another sheet treatment unit via the straight path in alignment with a line connecting said sheet receiving opening and said sheet discharging opening.

2. A sheet treatment apparatus according to claim 1, wherein said another sheet treatment unit is one of an adhering binder, a stacker, a stapler, and a folder.

3. A sheet treatment apparatus according to claim 1, wherein said straight path includes a sheet convey belt.

4. A sheet treatment apparatus according to claim 1, wherein said first and second sheet treatment units can convey a sheet bundle.

5. A sheet treatment apparatus according to claim 1 wherein said sorter is disposed at the intermediate or rearmost position among the first to third units, and a bookbinding apparatus as another unit is disposed upstream thereof.

6. An image forming apparatus having at least two sheet treatment units, comprising:

an image forming unit;

a first sheet treatment unit for receiving a sheet on which an image has been formed by said image forming unit and for first sheet treating the sheet; and a second sheet treatment unit for receiving the sheet treated by said first sheet treatment unit and for second sheet treating the sheet differently from the first sheet treating;

wherein a substantially fixed sheet discharging opening of said image forming apparatus has substantially the same height as a substantially fixed sheet receiving opening and a substantially fixed sheet discharging opening of said first sheet treatment unit and a substantially fixed sheet receiving opening and a substantially fixed sheet discharging opening of said second sheet treatment unit, and wherein said first sheet treatment unit is a sorter including (i) a plurality of bin trays separately arranged in a vertical direction between said sheet receiving opening and said sheet discharging opening, (ii) a straight path extending generally straight between and connecting said sheet receiving opening and said sheet discharging opening, and (iii) sheet carry means for carrying the sheet fed from said sheet receiving opening to said bin trays by a vertical movement thereof along said bin trays, said sheet carry means also constituting a portion of the straight path when the sheet is discharged to said second sheet treatment unit via the straight path.

7. An image forming apparatus according to claim 6, wherein said first and second sheet treatment units can convey a sheet bundle.

8. A sheet treatment apparatus adapted to be arranged downstream of an image forming apparatus and to receive and treat a sheet on which an image has been formed by said image forming apparatus, comprising:

a first sheet treatment unit having at both sides thereof a substantially fixed receiving opening to receive the sheet from said image forming apparatus and a substantially fixed discharging opening to discharge the sheet after a first sheet treatment, each being at substantially a same height as a substantially fixed discharging opening of said image forming apparatus; and a second sheet treatment unit having at both sides thereof a substantially fixed receiving opening to receive the sheet from the substantially fixed discharging opening of said first sheet treatment unit and a substantially fixed discharging opening to discharge the sheet after a second sheet treatment different from the first sheet treatment at substantially the same height as the substantially fixed discharging opening of said image forming apparatus, wherein said first sheet treatment unit is a sorter including (i) a plurality of bin trays separately arranged in a vertical direction between said sheet receiving opening and said the sheet discharging opening, (ii) a straight path extending generally straight between and connecting said sheet receiving opening and said sheet discharging opening, and (iii) sheet carry means for carrying the sheet fed from said sheet receiving opening to said bin trays by a vertical movement thereof along said bin trays, said sheet carry means constituting a part of the straight path when the sheet is discharged to said second sheet treatment unit via the straight path.

9. A sheet treatment apparatus arranged downstream of an image forming apparatus for receiving and treating a sheet on which an image has been formed, and for discharging the sheet to another sheet treatment apparatus arranged downstream thereof, characterized in that:

said sheet treatment apparatus comprises a plurality of bin trays separately arranged in a longitudinal direction between a substantially fixed sheet receiving opening and a substantially fixed sheet discharging opening thereof for sorting the sheets, and a straight path extending generally straight between and connecting said sheet receiving opening and said sheet discharging opening thereof; and that sheet carry means for carrying the sheets from said sheet receiving opening by a vertical movement along said bin trays and discharging the sheet to the bin trays, said sheet carry means also constituting a portion of the straight path when the sheets are discharged to another sheet treatment unit via the straight path in alignment with a line extending between the sheet receiving opening and the sheet discharging opening.

10. A sheet treatment apparatus according to claim 9, wherein said carry means is provided with sheet treatment means.

* * * * *

UNITED STATES PATENT AND TRADEMARK OFFICE

CERTIFICATE OF CORRECTION

PATENT NO. : 5,752,154

DATED : May 12, 1998

INVENTOR(S) : HIROYOSHI MARRUYAMA, ET AL.

It is certified that error appears in the above-identified patent and that said Letters Patent is hereby corrected as shown below:

On the title page:

Item [56] U.S. PATENT DOCUMENTS:

"Kasuga et al." should read --Kasuya et al.--.

COLUMN 1:

Line 38, "hight." should read --height.--.

COLUMN 3:

Line 48, "sheet" should read --sheets--.

COLUMN 4:

Line 7, "During" should read --While--; and
Line 49, "retarded" should read --retracted--.

COLUMN 5:

Line 23, "plurality" should read --plurality of--; and
Line 62, "a paper" should read --paper--.

COLUMN 6:

Line 61, "lengths," should read --length,--.

UNITED STATES PATENT AND TRADEMARK OFFICE

CERTIFICATE OF CORRECTION

PATENT NO. : 5,752,154

DATED : May 12, 1998

INVENTOR(S) : HIROYOSHI MARUYAMA, ET AL.

COLUMN 7:

Line 4, "can be also" should read --can also be--;
Line 5, "directions" should read --direction--;
Line 8, "retarded" should read --retracted--; and
Line 25, "During" should read --While--.

COLUMN 8:

Line 17, "combination" should read --cobminations--;
Line 33, "ends" should read --end--;
Line 51, "(Of" should read --(of--; and
Line 64, "slower slightly." should read --slightly slower--.

COLUMN 10:

Line 4, "claim 1" should read --claim 1,--;
Line 18, "treating;" should read --treating,--; and
Line 66, "the" should be deleted.

Signed and Sealed this

Twentieth Day of April, 1999

*Attest:*

*Attesting Officer*

Q. TODD DICKINSON

*Acting Commissioner of Patents and Trademarks*